US009144291B2

(12) United States Patent
Huang

(10) Patent No.: US 9,144,291 B2
(45) Date of Patent: Sep. 29, 2015

(54) TOOL HOLDER AND THE METHOD OF MAKING THEREOF

(71) Applicant: ALLPROFESSIONAL MFG. CO., LTD., Taichung (TW)

(72) Inventor: Chung-Ping Huang, Taichung (TW)

(73) Assignee: ALLPROFESSIONAL MFG. CO., LTD, Taichung (TW)

( * ) Notice: Subject to any disclaimer, the term of this patent is extended or adjusted under 35 U.S.C. 154(b) by 205 days.

(21) Appl. No.: 14/025,752

(22) Filed: Sep. 12, 2013

(65) Prior Publication Data

US 2015/0068936 A1 Mar. 12, 2015

(51) Int. Cl.
*A45C 1/04* (2006.01)
*A45F 5/00* (2006.01)

(52) U.S. Cl.
CPC ..... *A45F 5/00* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 2,590,187 | A * | 3/1952 | Langos | 224/575 |
| 3,294,298 | A * | 12/1966 | Danielson | 224/666 |
| 4,746,042 | A * | 5/1988 | King | 224/148.2 |
| 5,195,667 | A * | 3/1993 | Gallant | 224/197 |
| 5,501,382 | A * | 3/1996 | Webb | 224/673 |
| 5,547,115 | A * | 8/1996 | Ambrosius et al. | 224/240 |
| 5,810,232 | A * | 9/1998 | Meurer et al. | 224/677 |
| 6,264,079 | B1 * | 7/2001 | Skaggs | 224/193 |
| 6,945,440 | B1 * | 9/2005 | Ford | 224/148.6 |
| 8,453,898 | B2 * | 6/2013 | Ewins | 224/675 |
| 2002/0185509 | A1 * | 12/2002 | Wichman et al. | 224/677 |
| 2007/0170220 | A1 * | 7/2007 | Fragassi | 224/660 |
| 2010/0176174 | A1 * | 7/2010 | Felts | 224/666 |
| 2013/0146636 | A1 * | 6/2013 | Romero | 224/674 |

* cited by examiner

*Primary Examiner* — Jacob K Ackun
(74) *Attorney, Agent, or Firm* — Alan D. Kamrath; Kamrath IP Lawfirm, P.A.

(57) ABSTRACT

A tool holder includes a foldable plastic sheet being folded and configured to include a hanging end and a holding end. The hanging end and the holding end integrally form a one piece structure. The holding end having a first edge, a second edge, a first lateral edge, and a second lateral edge, with the first and second edges and the first and second lateral edges delimiting a circumferential periphery of a receiving space in which the first and second edges are opposite each other and the first and second lateral edges are opposite each other and respectively extend from two lateral sides of the first edge to two lateral sides of the second edge. A joint edge is distal the first lateral edge extending therefrom and adhered to the second lateral edge.

13 Claims, 10 Drawing Sheets

TOOL HOLDER AND THE METHOD OF MAKING THEREOF

BACKGROUND OF THE INVENTION

1. Field of the Invention

The present invention relates to a tool holder and the method of making thereof and, particularly to a tool holder having advantages of being produced quickly and at low cost and allowing a user to store and take out a tool conveniently and to hang it near the waist.

2. Description of the Related Art

Generally, a too box is too bulky for a worker to carry it in the working site conveniently, so the worker will use a portable and miniature tool holder to bring tools for a work and usually hang it near the waist to allow two hands available while working. Such tool holders are generally configured to receive various kinds of tools. However, these conventional tool holders not only take relatively long assembly time but are also expensive to make, and some tool receiving areas are not used all the time and become redundant.

The present invention is, therefore, intended to obviate or at least alleviate the problems encountered in the prior art.

SUMMARY OF THE INVENTION

According to the present invention, a tool holder includes a foldable plastic sheet being folded and configured to include a hanging end and a holding end. The hanging end and the holding end are delimited at different heights in a height direction of the tool holder. The hanging end and the holding end integrally form a one piece structure. The hanging end includes at least one slot extending therethrough. The holding end has a first edge, a second edge, a first lateral edge, and a second lateral edge, with the first and second edges and the first and second lateral edges delimiting a circumferential periphery of a receiving space. The first and second edges are opposite each other. The first and second lateral edges are opposite each other and respectively extend from two lateral sides of the first edge to two lateral sides of the second edge. Further, a joint edge is distal to the first lateral edge extending therefrom and adhered to the second lateral edge.

Furthermore, a method of making the tool holder includes preparing a material for making the tool holder, with the material being a foldable plastic sheet; shaping the material, with the material configured to include the hanging end and a holding end, with the hanging end and the holding end delimited at different heights in the height direction of the tool holder, with the hanging end including at least one slot extending therethrough, with the holding end having the first edge, the second edge, the first lateral edge, the second lateral edge, and the joint edge, with the first edge, the second edge, the first lateral edge, the second lateral edge, and the joint edge connected together in the width direction of the tool holder, with the width direction perpendicular to the height direction, with the first and second lateral edges and respectively extending from the two lateral sides of the first edge, with the first lateral edge connecting to the lateral side of the second edge, and with the joint edge being distal to the first lateral edge extending therefrom;

folding the holding end, with the holding end configured to include the first and second edges and the first and second lateral edges and a circumferential periphery of the receiving space; and adhering the joint edge to the second lateral edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a tool holder and the method of making thereof.

It is another object to provide a tool holder that is easy to make and has a simple structure, thereby reducing cost of manufacture.

It is yet another object to provide a tool holder that saves redundant tool receiving areas.

It is a further object to provide a tool holder that a user can carry conveniently when in use.

It is a yet further object to provide a tool holder that can be hanged when not in use.

Other objects, advantages, and new features of the present invention will become apparent from the following detailed description of the invention when considered in conjunction with the accompanied drawings.

DETAILED DESCRIPTION OF THE INVENTION

FIGS. 1 through 10 show a tool holder 1 and the method of making thereof in accordance with the present invention.

The tool holder 1 includes a foldable plastic sheet being folded and configured to include a hanging end 11 and a holding end 12. The plastic sheet is made of polypropylene. The plastic sheet has a uniform thickness. The hanging end 11 and the holding end 12 are delimited at different heights in a height direction of the tool holder 1. The hanging end 11 and the holding end 12 integrally form a one piece structure.

Figure 1:
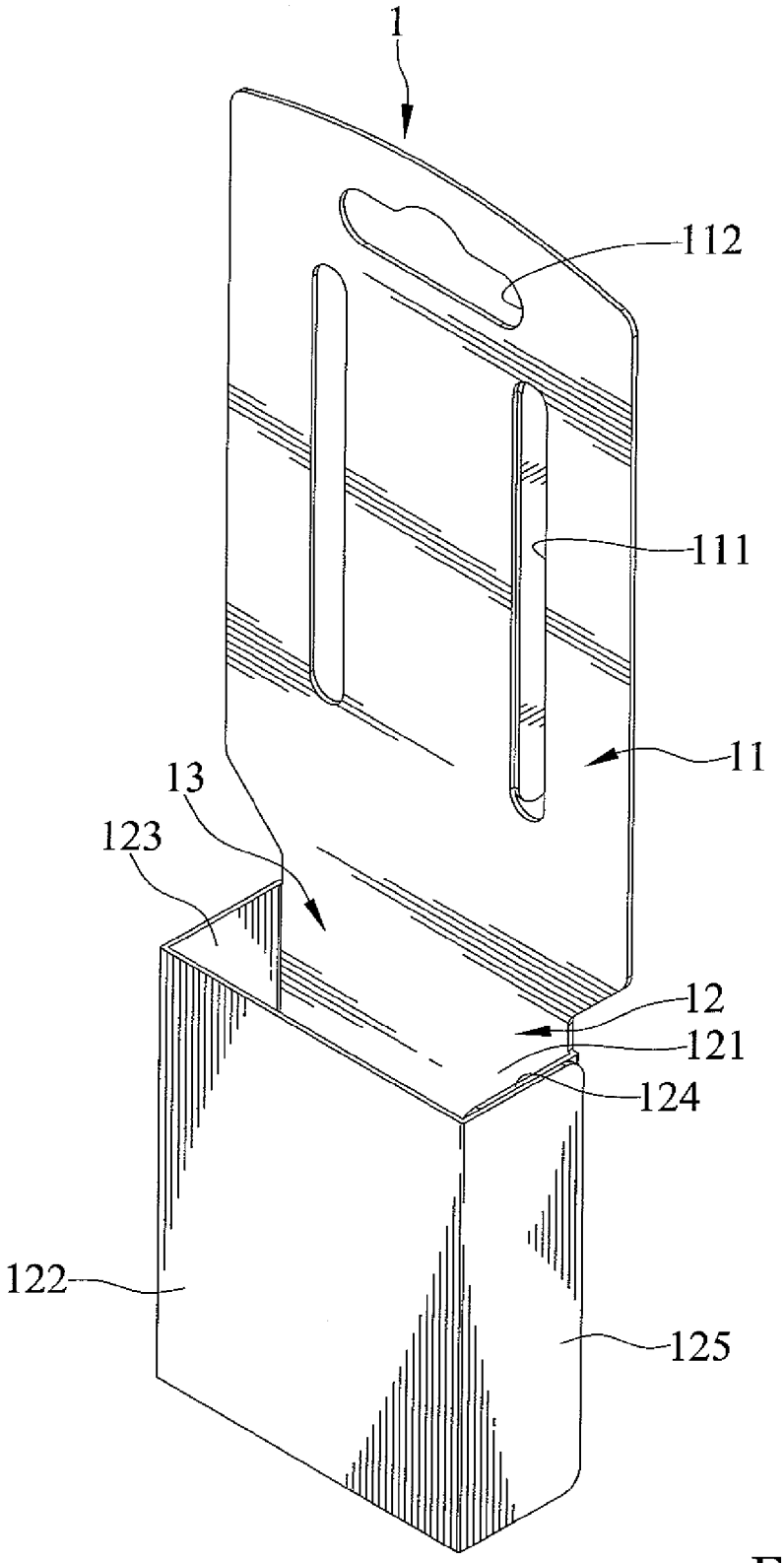
FIG. 1 is a perspective view of a tool holder in accordance with the present invention.
Figure 2:
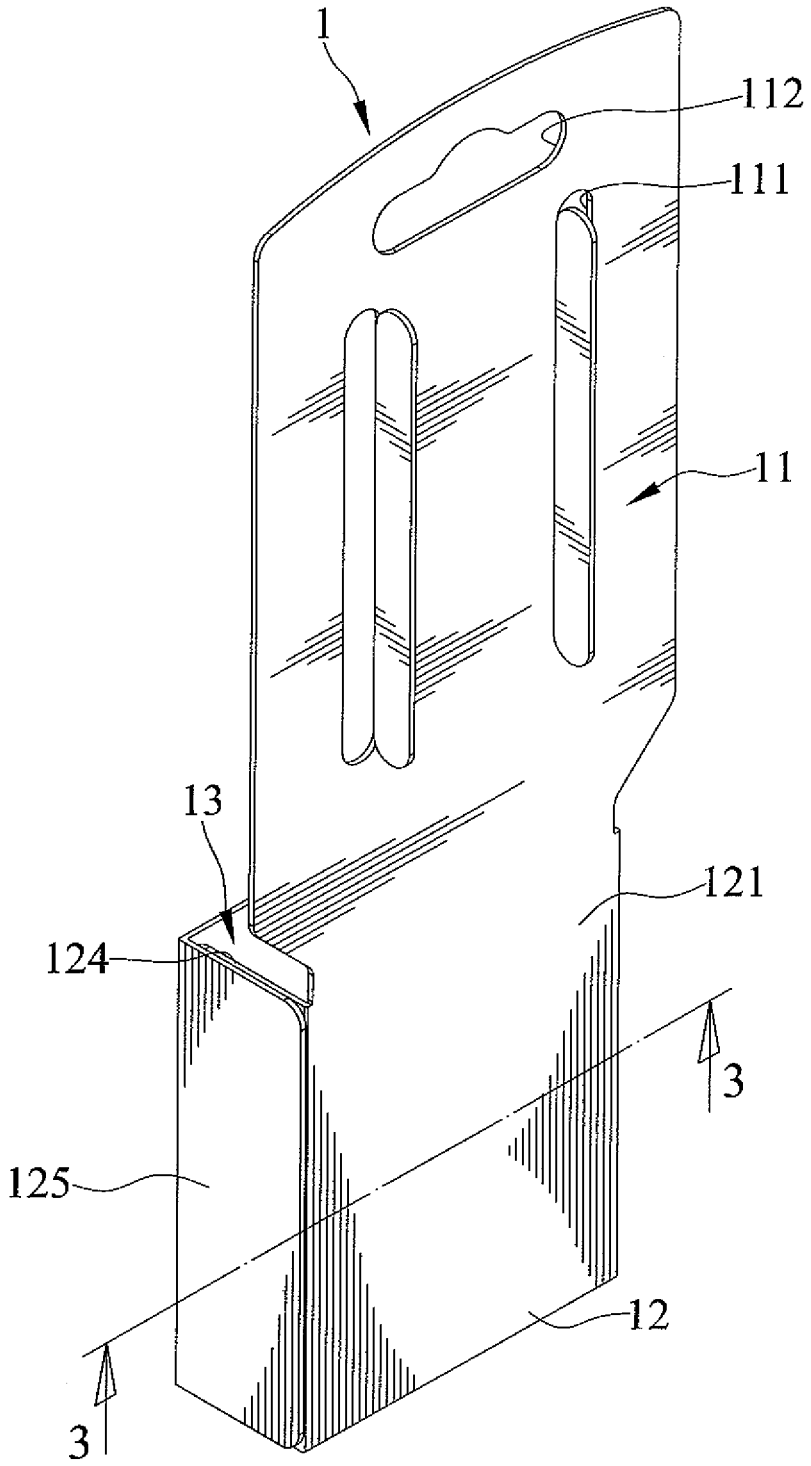
FIG. 2 is another perspective view of the tool holder, viewed from a different angle from that of FIG. 1.
Figure 3:
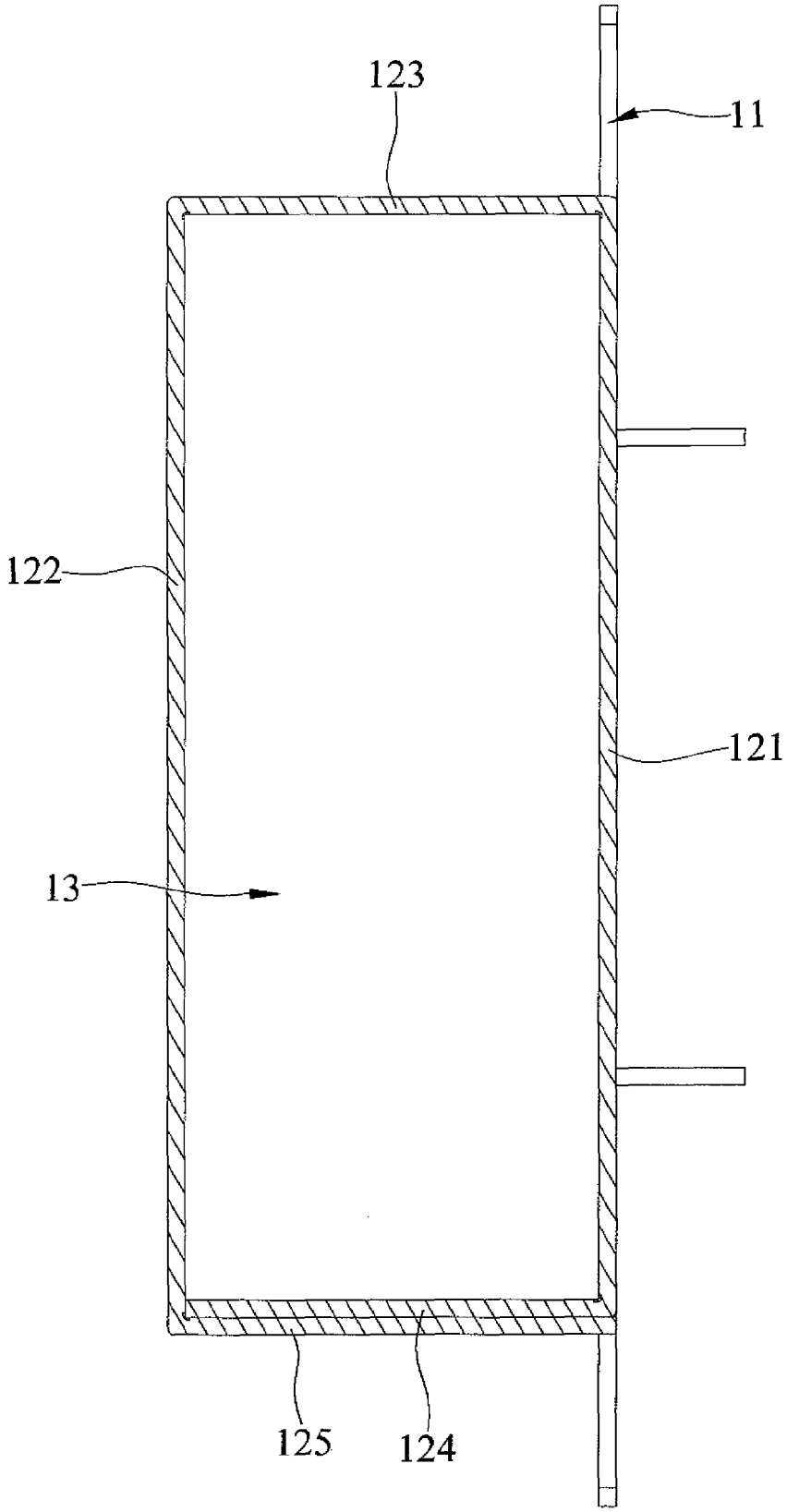
FIG. 3 is a cross-sectional view taken along line 3-3 of FIG. 2.
Figure 4:
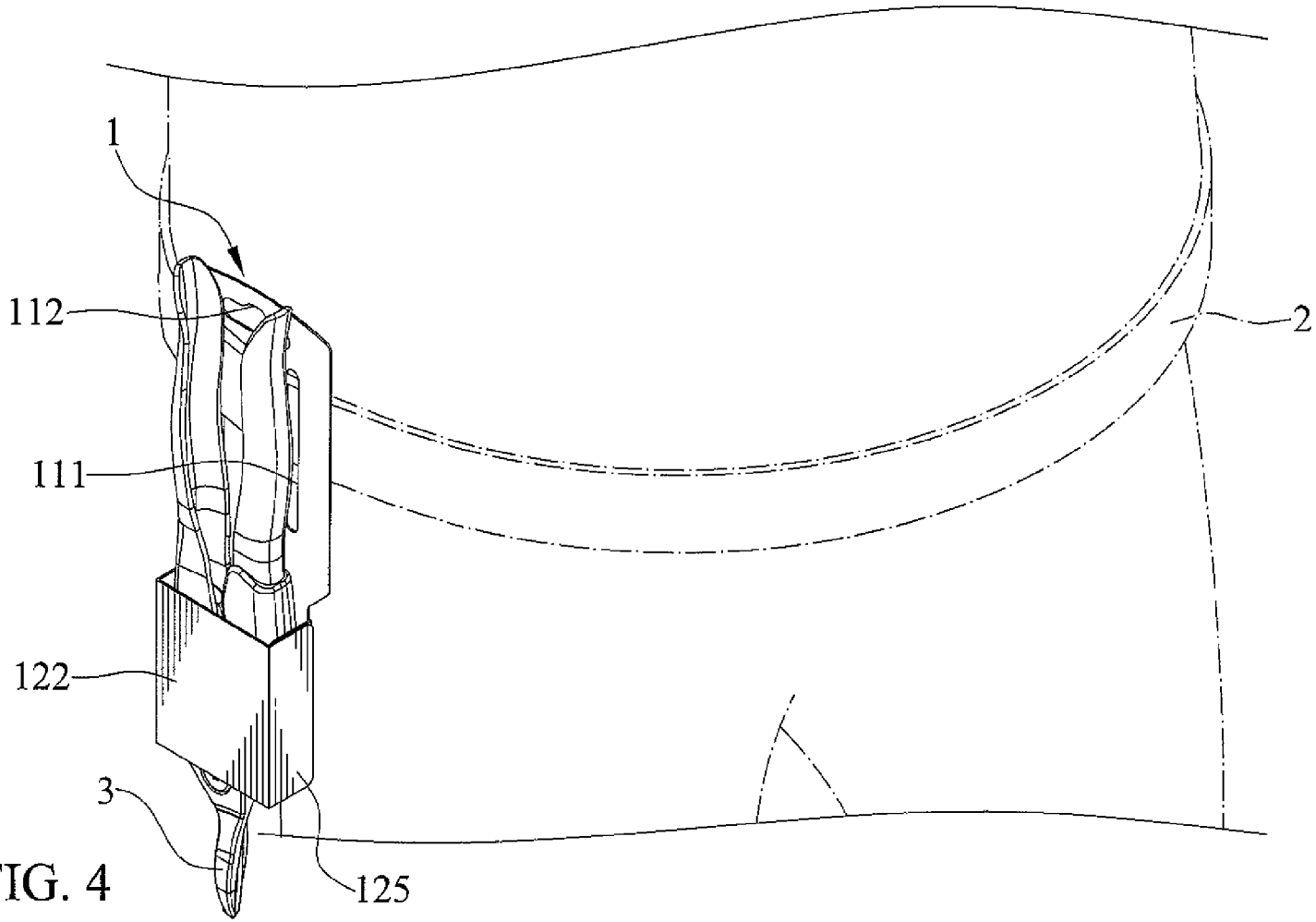
FIG. 4 shows the tool holder in use, with the tool holder receiving a tool and hanged near a waist of a user.
Figure 5:
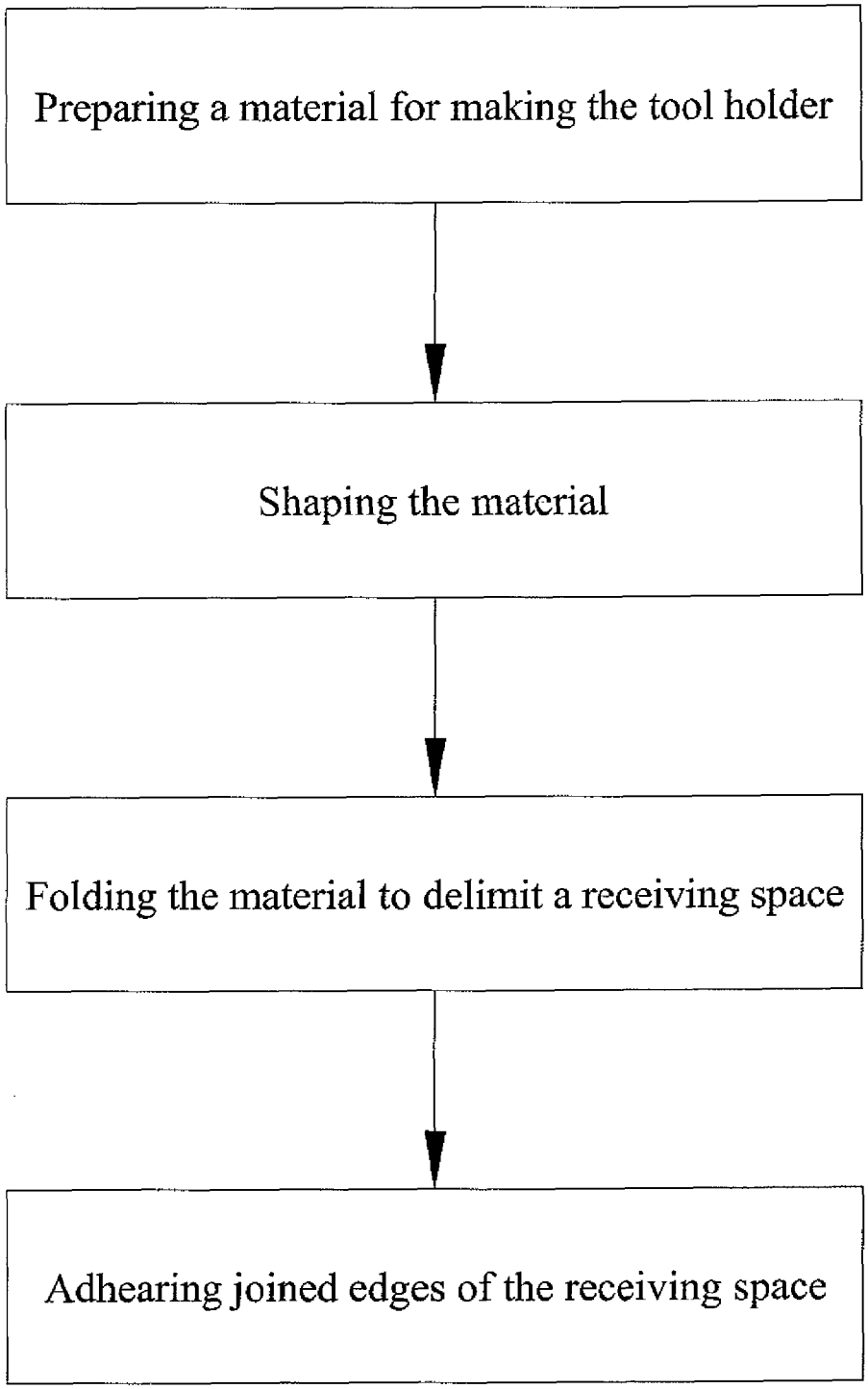
FIG. 5 is a flow-chart describing a method of making the tool holder of the present invention.
Figure 6:
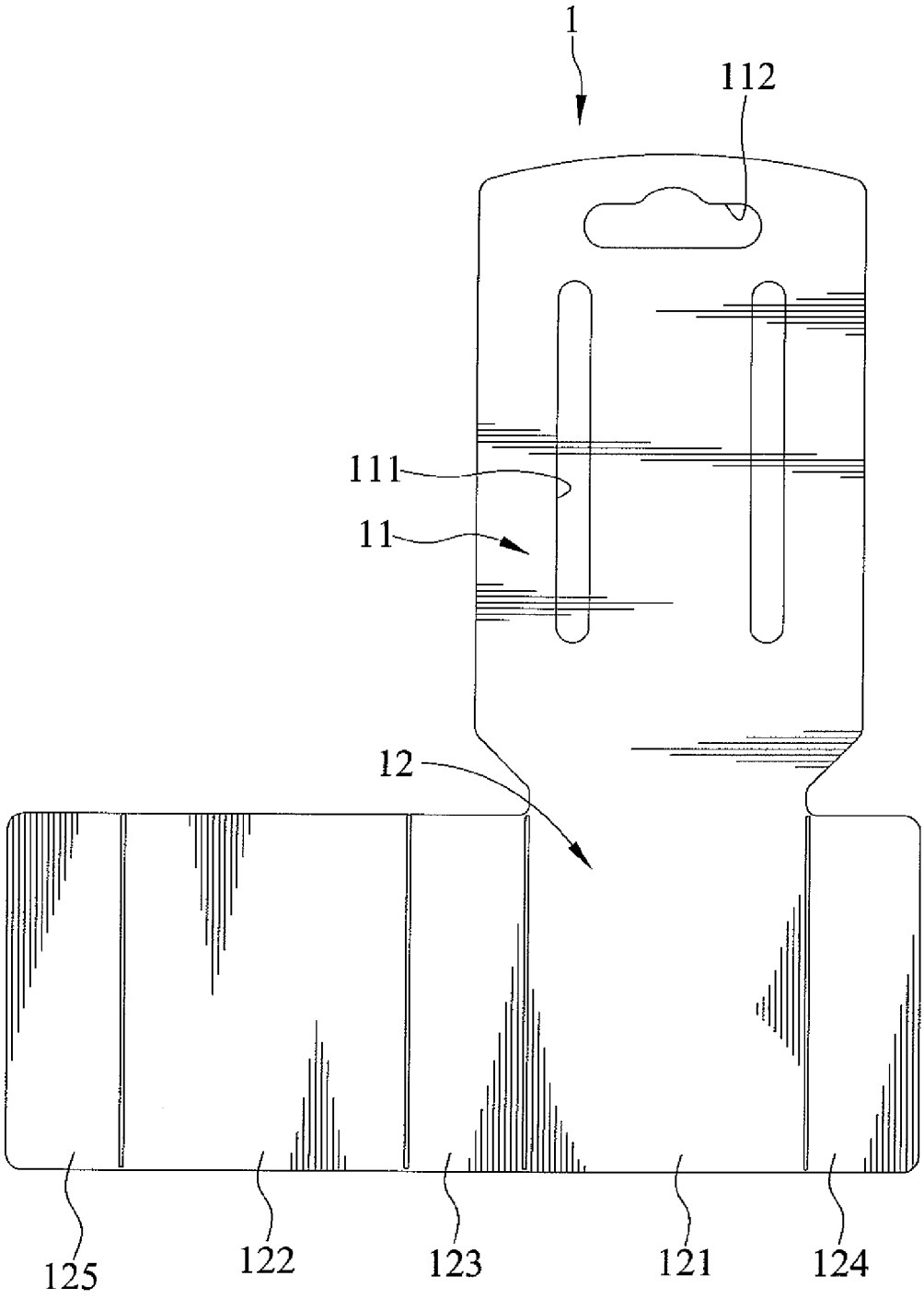
FIG. 6 shows a sheet for making the tool holder being cut into the predetermined shape after the cutting step.
Figure 7:
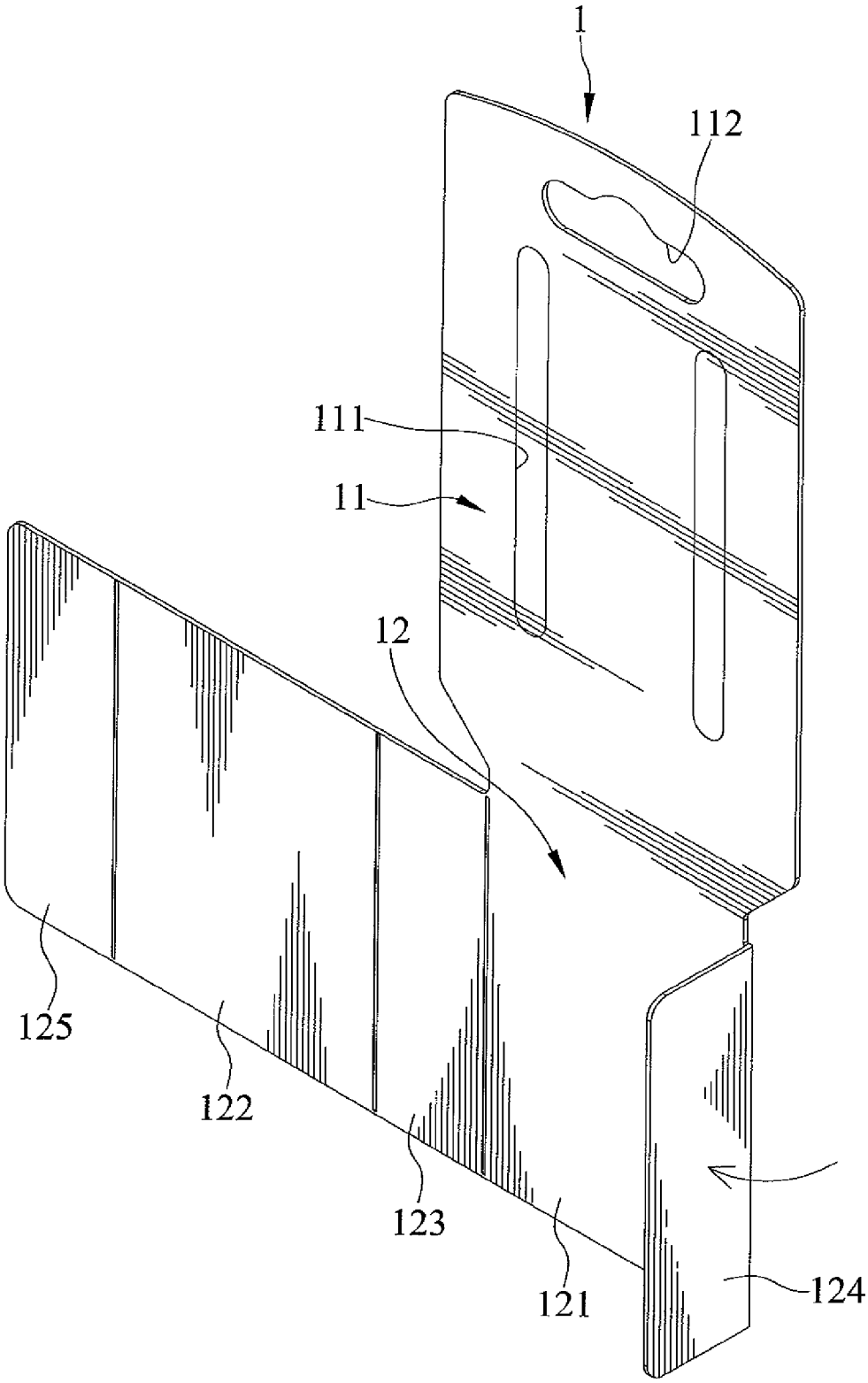
FIG. 7 shows the sheet in the folding step.
Figure 8:
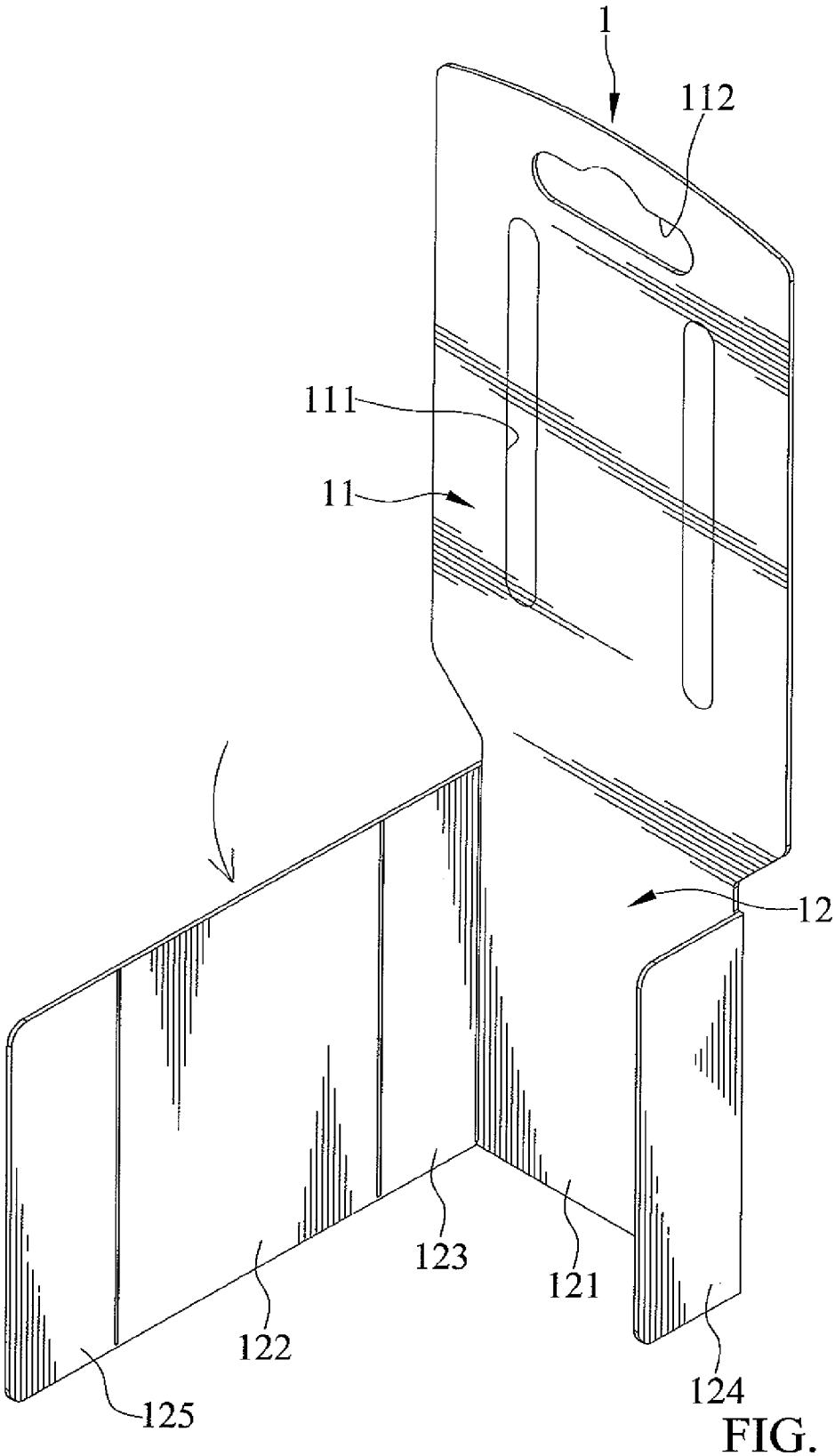
FIG. 8 is a continued view of FIG. 7, with the sheet in the folding step.
Figure 9:
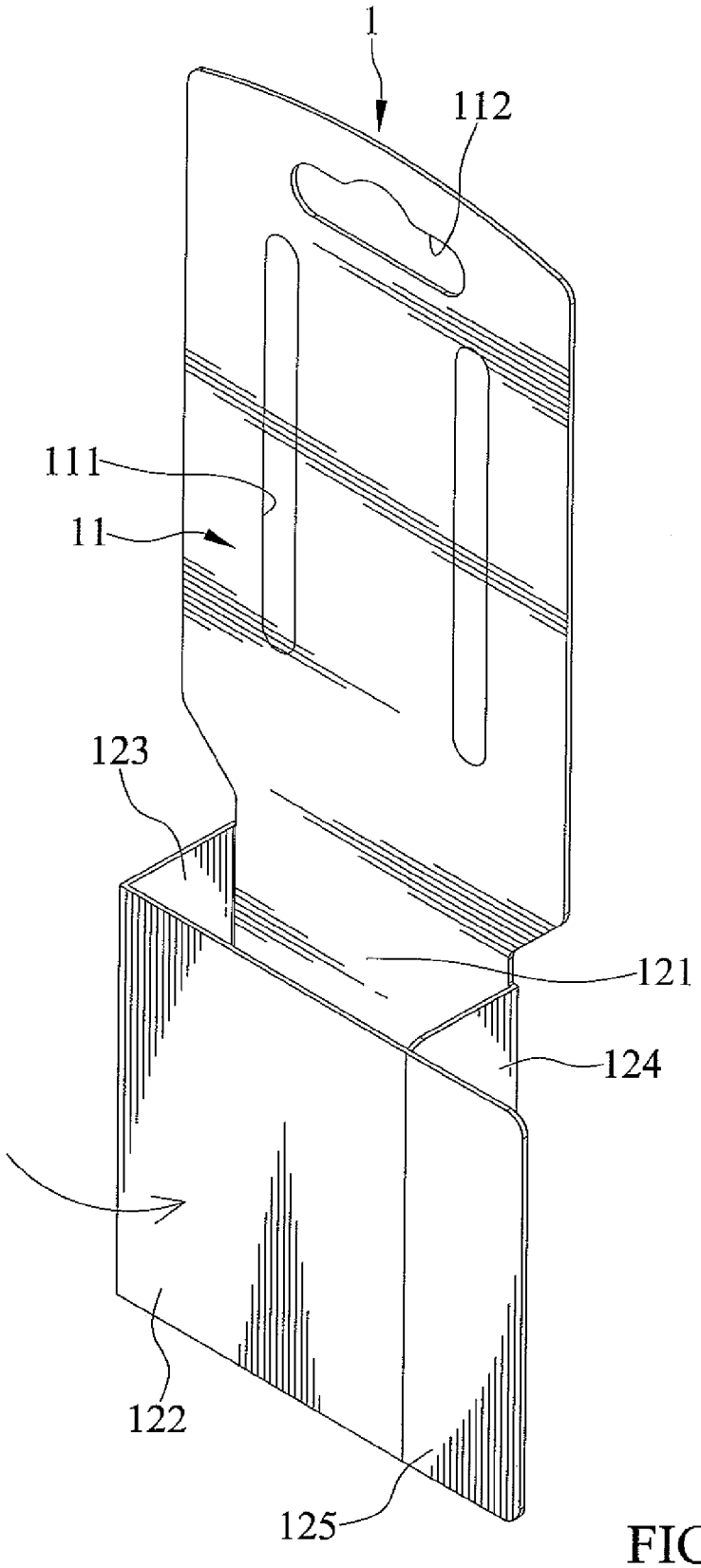
FIG. 9 is a continued view of FIG. 8, with the sheet in the folding step.
Figure 10:
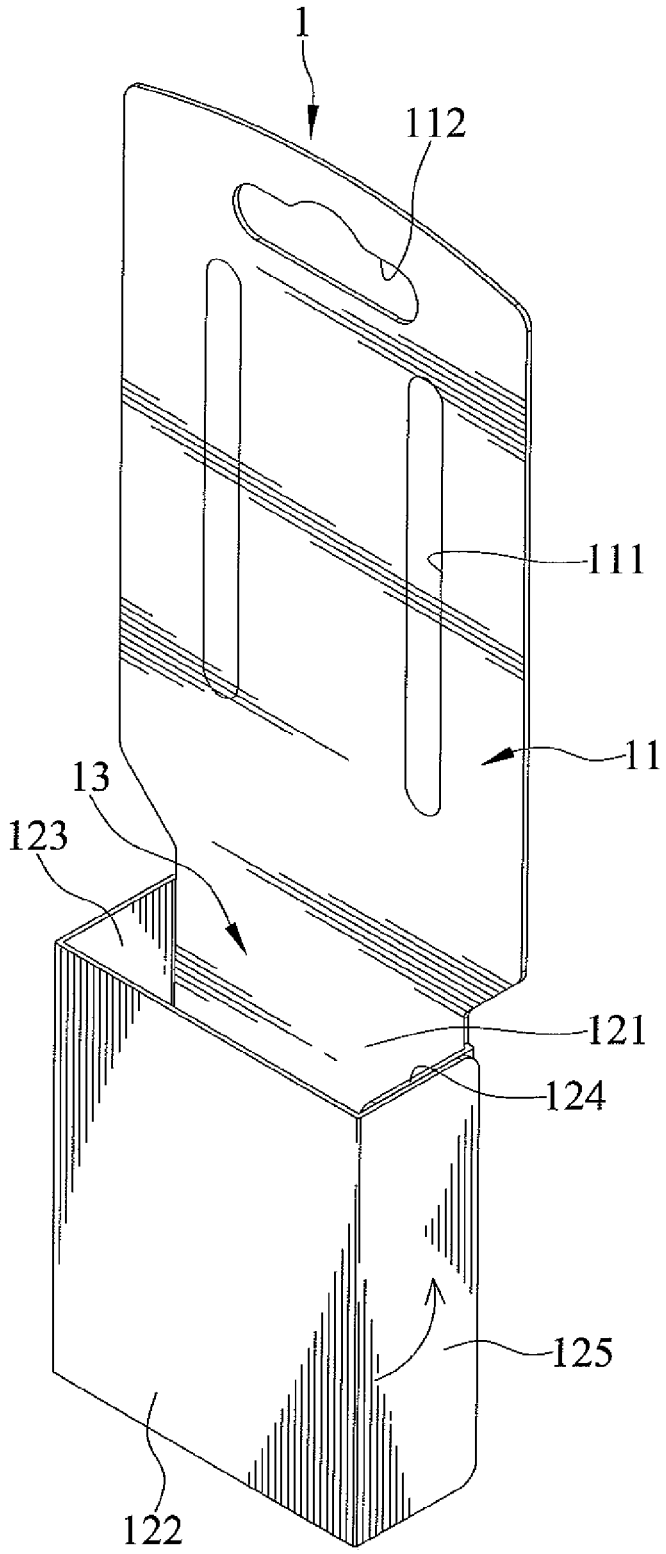
FIG. 10 is a continued view of FIG. 9, with the sheet in the adhering step.

The hanging end 11 includes at least one slot 111 extending therethrough. A user can carry the tool holder 1 conveniently as shown in FIG. 4. FIG. 4 shows the user wearing a belt 2, and by inserting through the belt 2 through the at least one slot 111 the tool holder 1 is engaged with the belt 2. In the embodiment, there are two slots 111. The hanging end 11 also includes a hang hole 112. Each of the two slots 111 and the hang hole 112 extend in the height direction of the tool holder 1 and respectively define first and second lengths. Additionally, each of the two slots 111 and the hang hole 112 extend in a width direction and respectively define first and second widths. The width direction is perpendicular to the height direction.

The holding end 12 has a first edge 121, a second edge 122, a first lateral edge 123, and a second lateral edge 124. The first and second edges 121 and 122 and the first and second lateral edges 123 and 124 are folded and delimit a circumferential periphery of a receiving space 13 in which the first and second edges 121 and 122 are opposite each other and the first and second lateral edges 123 and 124 are opposite each other and respectively extend from two lateral sides of the first edge 121 to two lateral sides of the second edge 122. Moreover, the first and second edge 121 and 122 are parallel to each other and have cross sections taken in the height direction of the tool holder 1 corresponding to each other, and the first and second lateral edges 123 and 124 are parallel to each other and have cross sections taken in the height direction of the tool holder 1 corresponding to each other. Further, a joint edge 125 is distal to the first lateral edge 123 extending therefrom and adhered to the second lateral edge. The joint edge 125 is adhered to the second lateral edge 124 using a high-frequency method. The first lateral edge 123, the second lateral edge 124 and the joint edge 125 are folded 90 degrees with respect to the first edge 121 and the second edge 122.

The receiving space 13 is used to receive a tool 3, as shown in FIG. 4. The receiving space 13 has a top open end and a bottom open end opposite to the top open end in the height direction of the tool holder 1. It is convenient for a user to use the tool holder 1 to hold the tool 3 because the tool 3 can be disposed in the receiving space 13 through the first open end. Likewise, the user can take the tool 3 out of the tool holder 1 conveniently.

Furthermore, the thickness of plastic sheet is uniform in which the hanging end 11, the first and second edges 121 and 122, first and second lateral edges 121 and 122, and the joint edge 125 have the same thickness. It is therefore simple to make the plastic sheet.

In addition, the hang hole 112 is disposed near a top distal end of the hanging end 11, which is opposite to a bottom distal end which connects with the first edge 121 of the holding end 12, allowing the user to hang the tool holder 1 on a hook conveniently. The hang hole 112 is also disposed at a center of the hanging end 11, allowing the tool holder 1 to be hanged in a stable position easily.

With regard to a method of making the tool holder 1, the method includes preparing a material for making the tool holder 1, with the material being a foldable plastic sheet; shaping the material, with the material configured to include the hanging end 11 and a holding end 12, with the hanging end 11 and the holding end 12 delimited at different heights in the height direction of the tool holder 1, with the hanging end 11 including at least one slot 111 extending therethrough, with the holding end 12 having the first edge 121, the second edge 122, the first lateral edge 123, the second lateral edge 124, and the joint edge 125, with the first edge 121, the second edge 122, the first lateral edge 123, the second lateral edge 124, and the joint edge 125 connected together in the width direction of the tool holder 1, with the width direction perpendicular to the height direction, with the first and second lateral edges 123 and 124 respectively extending from the two lateral sides of the first edge 121, with the first lateral edge 123 connecting to the lateral side of the second edge 122, and with the joint edge 125 being distal to the first lateral edge 123 extending therefrom;

folding the holding end 12, with the holding end 12 configured to include the first and second edges 121 and 122 and the first and second lateral edges 123 and 124 delimiting a circumferential periphery of the receiving space 13; and adhering the joint edge 125 to the second lateral edge 124.

The material prepared is made of polypropylene.

In the folding process, the first lateral edge 123, the second lateral edge 124 and the joint edge 125 are folded 90 degrees with respect to the first edge 121 and the second edge 122, and the receiving space 13 has a top open end and a bottom open end opposite to the top open end in the height direction of the tool holder 1.

In the shaping process, the material is also configured to include the hang hole 112, with the at least one slot 111 and the hang hole 112 extending in the height direction of the tool holder 1 and respectively define first and second lengths, with the at least one slot 111 and the hang hole 112 extending in a width direction and respectively define first and second widths, with the width direction perpendicular to the height direction. In the embodiment, two slots 111 are shaped and disposed in a parallel relation. Moreover, the material is shaped in which the first edge 121, the second edge 122, the first lateral edge 123, and the second lateral edge 124 have rectangular cross sections taken in the height direction of the tool holder 1.

In the adhering process, the joint edge 125 is adhered to the second lateral edges 124 using a high-frequency method.

In view of the forgoing, the tool holder 1 is a one piece structure, and the receiving space 13 is in a shape that saves redundant tool receiving areas. Furthermore, a user can carry the tool holder 1 conveniently when in use, and it can be hanged when not in use.

While the specific embodiments have been illustrated and described, numerous modifications come to mind without significantly departing from the spirit of invention, and the scope of invention is only limited by the scope of accompanying claims.

What is claimed is:

1. A tool holder comprising:

a foldable plastic sheet being folded and configured to include a hanging end and a holding end, with the hanging end and the holding end delimited at different heights in a height direction of the tool holder, with the hanging end and the holding end integrally forming a one piece structure, with the hanging end including at least one slot extending therethrough, with the holding end having a first edge, a second edge, a first lateral edge, and a second lateral edge, with the first and second edges and the first and second lateral edges delimiting a circumferential periphery of a receiving space in which the first and second edges are opposite each other and the first and second lateral edges are opposite each other and respectively extend from two lateral sides of the first edge to two lateral sides of the second edge, and a joint edge being distal to the first lateral edge extending therefrom and adhered to the second lateral edge.

2. The tool holder as claimed in claim 1, wherein the plastic sheet has a uniform thickness in which the hanging end, the first and second edges, first and second lateral edges, and the joint edge have the same thickness.

3. The tool holder as claimed in claim 1, wherein the hanging end includes a hang hole, wherein the at least one slot and the hang hole extend in the height direction of the tool holder and respectively define first and second lengths, and wherein the at least one slot and the hang hole extend in a width direction and respectively define first and second widths, with the width direction perpendicular to the height direction.

4. The tool holder as claimed in claim 1, wherein the first and second edge are parallel to each other and have cross sections taken in the height direction of the tool holder corresponding to each other, and wherein the first and second lateral edges are parallel to each other and have cross sections taken in the height direction of the tool holder corresponding to each other.

5. The tool holder as claimed in claim 1, wherein the joint edge is adhered to the second lateral edge using a high-frequency method.

6. The tool holder as claimed in claim 1, wherein the receiving space has a top open end and a bottom open end opposite to the top open end in the height direction of the tool holder.

7. A method of making a tool holder comprising:

preparing a material for making the tool holder, with the material being a foldable plastic sheet;

shaping the material, with the material configured to include a hanging end and a holding end, with the hanging end and the holding end delimited at different heights in a height direction of the tool holder, with the hanging end including at least one slot extending therethrough, with the holding end having a first edge, a second edge, a first lateral edge, a second lateral edge, and a joint edge, with the first edge, the second edge, the first lateral edge, the second lateral edge, and the joint edge connected together in a width direction of the tool holder, with the width direction perpendicular to the height direction, with the first and second lateral edges respectively extending from two lateral sides of the first edge, with the first lateral edge connecting to a lateral side of the second edge, and with the joint edge being distal to the first lateral edge extending therefrom;

folding the holding end, with the holding end configured to include the first and second edges and the first and second lateral edges delimiting a circumferential periphery of a receiving space; and adhering the joint edge to the second lateral edge.

8. The method of making a tool holder as claimed in claim 7, wherein the first lateral edge, the second lateral edge and the joint edge are folded 90 degrees with respect to the first edge and the second edge.

9. The method of making the tool holder as claimed in claim 7, wherein the material is shaped, with the material configured to include a hang hole, with the at least one slot and the hang hole extending in the height direction of the tool holder and respectively define first and second lengths, with the at least one slot and the hang hole extending in a width direction and respectively define first and second widths, with the width direction perpendicular to the height direction.

10. The method of making the tool holder as claimed in claim 7, wherein the material is shaped, with the first edge, the second edge, the first lateral edge, and the second lateral edge have rectangular cross sections taken in the height direction of the tool holder.

11. The method of making the tool holder as claimed in claim 7, wherein the material prepared for making the tool holder is made of polypropylene.

12. The method of making the tool holder as claimed in claim 7, wherein the material is adhered, with the joint edge adhered to the second lateral edges using a high-frequency method.

13. The method of making the tool holder as claimed in claim 7, wherein the material is folded, with receiving space having a top open end and a bottom open end opposite to the top open end in the height direction of the tool holder.

* * * * *